United States Patent [19]

Chen

[11] Patent Number: 5,033,897

[45] Date of Patent: Jul. 23, 1991

[54] HAND HELD SHOWER APPARATUS

[76] Inventor: I-Cheng Chen, No. 253-3, Chuang-Ching Rd., Panchiao, Taiwan

[21] Appl. No.: 467,562

[22] Filed: Jan. 19, 1990

[51] Int. Cl.[5] ..... A46B 11/04; A47L 13/22; A62C 31/00

[52] U.S. Cl. ..... 401/281; 401/288; 401/289; 401/268; 239/449; 239/117; 239/447

[58] Field of Search ..... 401/280, 281, 270, 284, 401/289, 288, 268; 239/448, 449, 238, 117, 301, 391, 447

[56] References Cited

U.S. PATENT DOCUMENTS

| | | | |
|---|---|---|---|
| 3,782,837 | 1/1974 | Feldman | 401/281 |
| 3,929,287 | 12/1975 | Givler | 239/447 |
| 4,081,135 | 3/1978 | Tomaro | 239/447 |
| 4,204,646 | 5/1980 | Shames | 239/449 |
| 4,330,089 | 5/1982 | Finkbeiner | 239/449 |
| 4,703,893 | 11/1987 | Gruber | 239/391 |
| 4,838,486 | 6/1989 | Finkbeiner | 239/117 |
| 4,895,468 | 1/1990 | Chappell | 401/270 |

*Primary Examiner*—Danton D. DeMille
*Attorney, Agent, or Firm*—Shlesinger, Arkwright & Garvey

[57] ABSTRACT

The hand held shower apparatus of this invention includes a shower body having a hollow handle connectable at one end to a source of water and a shower head, water regulating means for regulating the supplied water into two different water streams, one with a showering effect and the other with a massaging effect, and a cap member having a perforated bottom surface with two groups of holes for the two water streams. The hollow handle is constructed in such a way that it can be extended by pulling it away from the shower head. The shower apparatus also has a shower utensil, such as a shower brush, connected with the cap member in such a way that the shower utensil moves up or down when rotated clockwise or counterclockwise with respect to the cap member. Construction of the shower apparatus has been made simple so that it can be assembled or disassembled with ease. Other embodiments of the shower utensil are also presented.

9 Claims, 6 Drawing Sheets

HAND HELD SHOWER APPARATUS

BACKGROUND OF THE INVENTION

The present invention relates to a hand held shower apparatus, more particularly to a type of shower apparatus which has a means for regulating water flow and a variety of shower utensils, such as a shower brush or a shower comb, detachably incorporated with the shower head.

It is well known that hand held shower apparatuses have been slowly gaining popularity in most households. Most recent models of such apparatuses include a muscle-powered shower described in U.S. Pat. No. 4,829,609 and a water-powered rotating shower brush described in U.S. Pat. No. 4,841,590. A common deficiency of prior hand held shower apparatuses is that they lack means for regulating the flow of water While U.S. Pat. No. 4,841,590 introduces a knob for varying the angular velocity of the brush, it does not provide for an output of water.

Another common deficiency of prior hand held shower apparatuses is that they are capable of producing only one kind of water stream.

SUMMARY OF THE INVENTION

It is therefore a main object of this invention to provide a hand held shower apparatus which incorporates in the shower head a means of regulating the flow of water.

Another object of the present invention is to provide a hand held shower apparatus which not only can provide a water stream with a showering effect, but also can provide a water stream with a massaging effect.

Still another object of the present invention is to provide a hand held shower apparatus which incorporates a shower utensil, such as a shower brush, in the shower head.

Yet another object of this invention is to provide a hand held shower apparatus which is extendible, making it easier for the user to scrub areas which are hard to reach.

A further object of this invention is to provide a hand held shower apparatus which can be adapted to different water outlets such as an ordinary faucet.

Another further object of this invention is to provide a hand held shower apparatus with a simple construction that can be manufactured with detachable and easy-to-assemble parts, which may be made of rigid plastic, making the apparatus lightweight and more economical.

Accordingly, the present invention provides a hand held shower apparatus comprising a shower body having a hollow handle connected to a water supply and a shower head, water regulating means, a cap member to serve as an outlet means for the supplied water, and a shower utensil, such as a shower brush, incorporated in the shower head.

Specifically, the water regulating means in the shower head has an axial cylindrical wall with grooves and an opening at its outer surface. The water regulating means is connected to an external rotary knob which, when rotated, would causes a corresponding rotation of said water regulating means.

The cap member of this invention comprises a perforated bottom surface with two groups of holes which serve as outlet means for two different water streams. The shower utensil of this invention is joined to the above mentioned cap member in such a way that it can be rotated clockwise or counter clockwise to move up or down with respect to said cap member.

Finally, the hollow handle of this invention can be extended by pulling said handle away from the shower head, giving it more flexibility in terms of user movements.

BRIEF DESCRIPTION OF THE DRAWINGS

Other features and advantages will become apparent in the following detailed description of a preferred embodiment of this invention, with reference to the accompanying drawings, in which.

DETAILED DESCRIPTION OF THE PREFERRED EMBODIMENT

Figure 1:
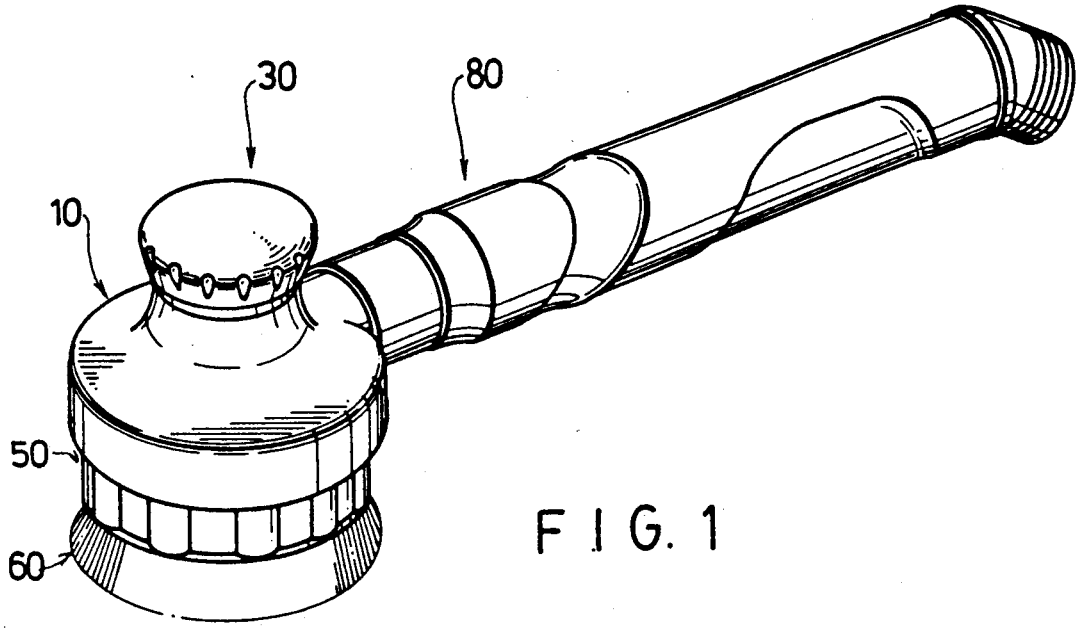
FIG. 1 is a schematic view of a preferred embodiment according to the present invention.

Referring to FIG. 1, a schematic view of a shower apparatus according to this invention is shown to comprise a shower body having a shower head 10 and a hollow handle 80, a rotary knob 30 rotatably mounted on top of said shower head 10, a shower utensil casing 50, and a shower utensil 60.

Figure 2:
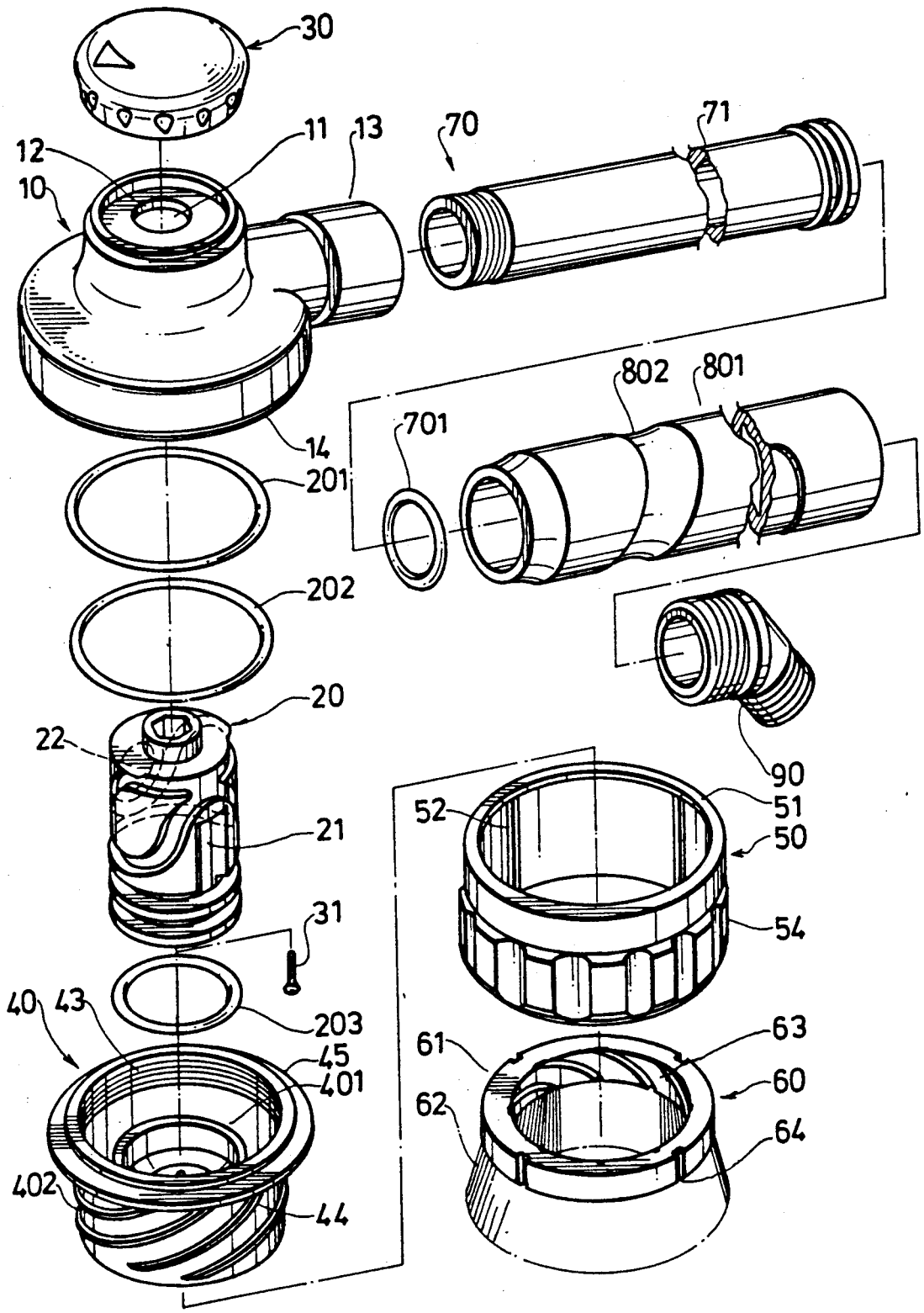
FIG. 2 is an exploded perspective view of a preferred embodiment according to the present invention.

FIG. 2 shows water pipe 13 threaded to one end of a water pipe 70. The other end 71 of the water pipe 70 is connected to an external source of water. An "0" ring 701 is placed at the end 71 to prevent any leakage between the water pipe 70 and the source of water. A handle casing 801 comprising an elongated cylinder with two open ends has a converging diameter with the smallest diameter slightly bigger than the end 71 of the water pipe 70. The handle casing 801 is slipped through the water pipe 70 with the smallest end diameter facing water pipe 13. The handle casing 801 has a notch 802 for pulling said handle casing 801 away from the water pipe 70, thereby creating a longer handle. One end of a hollow element 90 is threaded to handle casing 801, the other end being slightly bent and serving to guide a tube feed or a flexible pipe coming from the water source.

Figure 3:
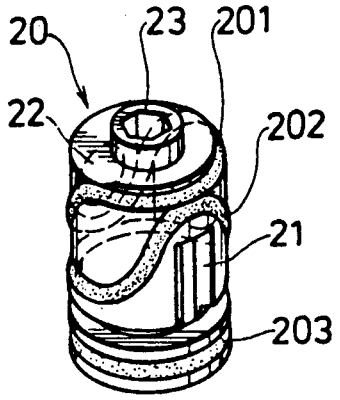
FIG. 3 is a detailed schematic view of a part of the preferred embodiment.

The shower head 10 is connected to the water pipe 13 at one side. Shower head 10 comprises a hollow bubble or bell-shaped casing with an inner cylindrical wall which forms an inner cavity 11, an opening 12 at the top and threads 14 surrounding its peripheral bottom edge. The inner cavity 11 contains a water regulating means 20 having an axial cylindrical wall defining an axial hollow portion with a side groove 21, serving as a guide channel and an opening to access center guide channel 22 inside the axial hollow portion. Two "0" rings 201, 202, are arranged along the edges of the groove 21 and the opening to access guide channel 22 in such a way that the two channels are isolated from each other. FIG. 3 illustrates the positioning of the two "0" rings 201, 202 along the water regulating means 20. The water regulating means 20 further comprises a protrusion with a mounting hole 23 at its top. A mounting screw 31 passes through the mounting hole 23 and the opening 12 of said shower head 10 to a rotary knob 30. Rotating the rotary knob 30 causes the water regulating means 20 to rotate in the same direction. The rotary knob 30 is usually marked on top to give the user an indication as to the positioning of the guide channels.

Figure 4:
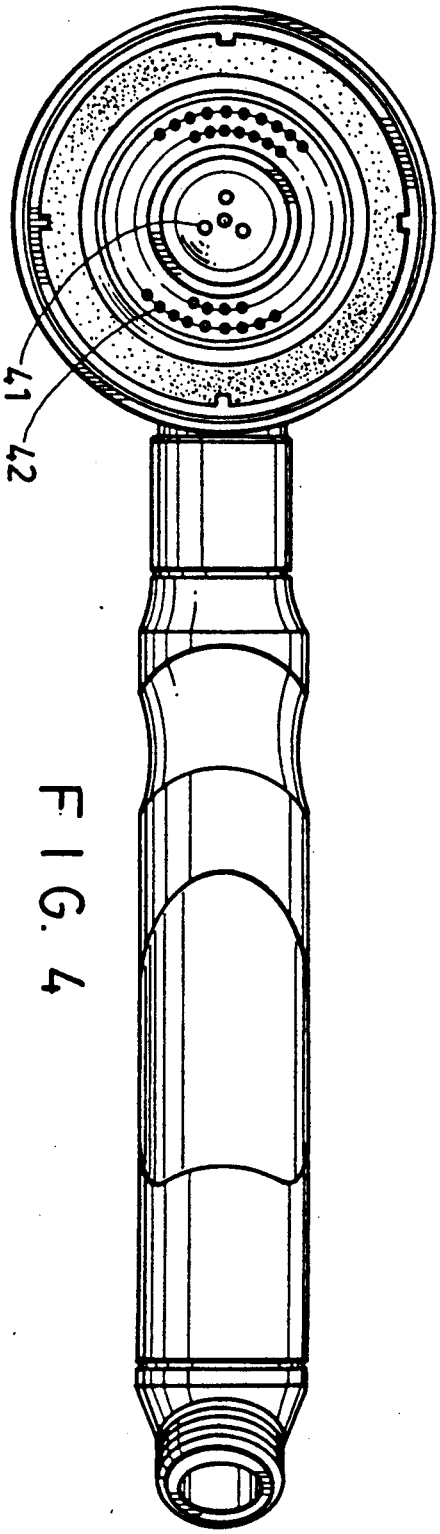
FIG. 4 is a bottom view of FIG. 1.

The cap member 40 comprises two superimposed vertical cylinders of different diameters about a common vertical axis. The bottom surface of the cap member 40 is perforated, with the middle portion of the bottom surface indented The inner partition wall 401 of the cap member 40 supports the bottom of the water regulating means 20 inside the inner cavity 11. An "0" ring 203 seals said water regulating means 20 to the cap member 40. A group of shower holes 41 at the indented portion of the cap member 40 and directly below the water regulating means 20 serves as an outlet means for water coming in from guide channel 22. Another group of shower holes 42 surround the indented portion of the cap member 40 and serves as an outlet means for water coming in from guide channel 21. The inner partition wall 401 of the cap member 40 separates the two groups of shower holes A bottom view of the preferred embodiment showing the formation of said shower holes is illustrated in FIG. 4. The inner surface of the outer cylindrical wall 402 of the cap member 40 has spiral grooves 43 at its top edge so that it can be joined to the threads 14 of shower head 10. The cap member 40 further comprises threads 44 at the outer surface of its outer cylindrical wall 402 and an annular flange member 45 outwardly extending from the top edge of the same.

A shower utensil casing 50 comprises an annular wall with an endless flange member 51 inwardly and radially extending from the top edge of its inner partition wall. The shower utensil casing 50 is sleeved over the cap member 40 and inside the shower head 10. The protrusions 51, 45 of the shower utensil casing 50 and the cap member 40 respectively, prevent said shower utensil casing 50 from disengaging from said cap member 40, and at the same time allow said shower utensil casing 50 to freely move up and down with respect to said cap member 40. A plurality of axial key members 52 form vertical protrusions along the inner partition wall of the shower utensil casing 50.

A shower utensil 60, such as a shower brush, comprises a base 61 shaped as a ring, a plurality of brush bristles 62 affixed to the base 61, and spiral grooves 63 for joining said base 61 to the outer surface of the cap member 40. The base 61 further comprises a plurality of key ways 64 at its outer surface, the key ways 64 having a number equal to the axial key members 52. The base 61 is fitted to the shower utensil casing 50 through the axial key members 52 and the key ways 64. The spiral grooves 63 allow the base 61 to be rotated with respect to the cap member 40. The cooperation of the key ways 64 and the axial key members 52 hinder the relative rotation of the shower utensil casing 50 to the base 61. The shower utensil casing 50 further comprises a plurality of protrusions 54 along its outer walls to facilitate easier handling when rotating the shower utensil 60.

Figure 5:
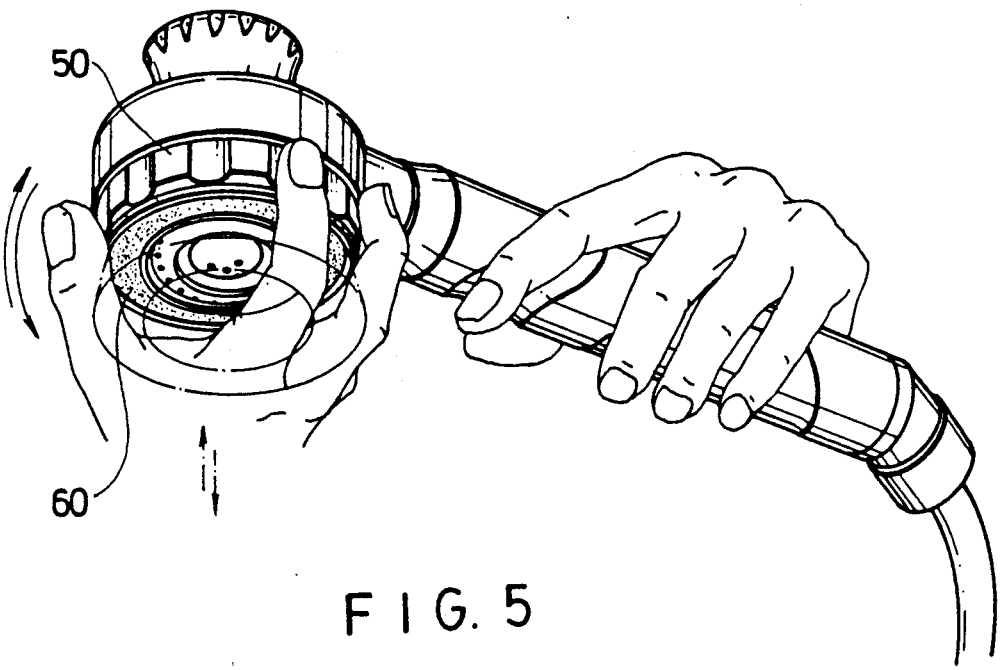
FIG. 5 is an illustration of the operation of the present invention.

FIG. 5 shows a schematic view of a shower apparatus of this invention in operation. Shower utensil 60 can be moved up or down by rotating the shower utensil casing 50 clockwise or counter clockwise.

As shown in the succeeding figures, the flow of water through the shower apparatus of this invention can have four different modes. In the first mode, water passes only through the guide channel 21, thereby creating a showering effect. In the second mode, water passes only through guide channel 22, thus creating a water spout with a massaging effect. In the third mode, water passes through both channels. In the fourth mode, no water passes through either channel. The flow of water varies depending upon the positioning of the two guide channels 21, 22 with respect to water pipe 13. The positioning of the guide channels 21, 22 is varied by rotating rotary knob 30.

Figure 6:
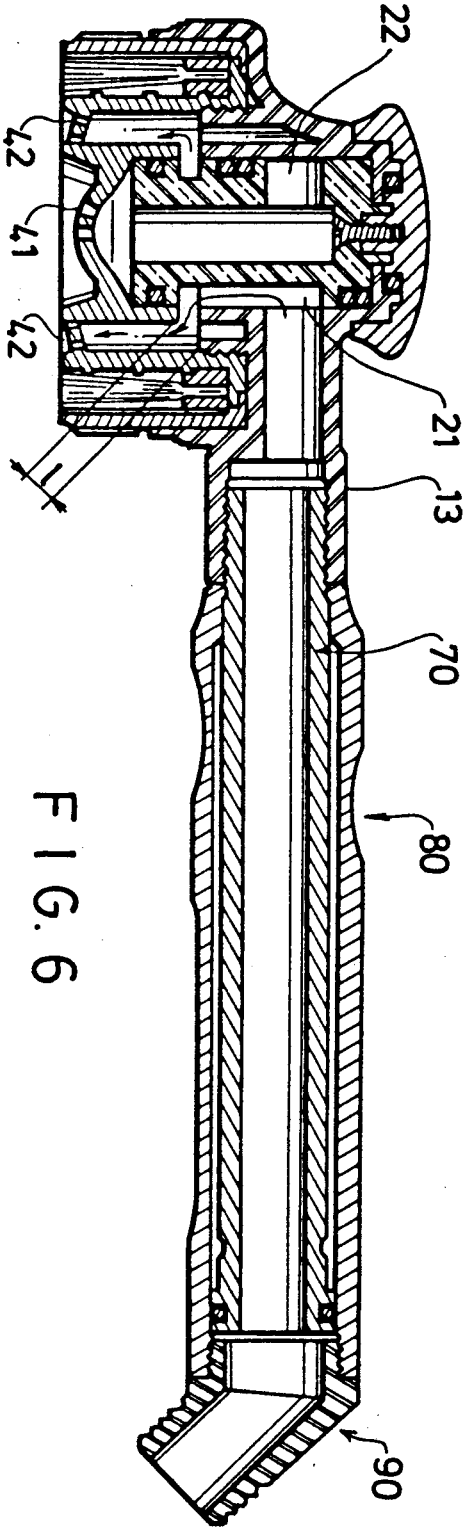
FIG. 6 is a sectional view of the present invention operating with a showering stream.

FIG. 6 shows a sectional view of the preferred embodiment in operation. Water, coming in from an external supply, passes through water pipe 70 and then through water pipe 13 to the opening of guide channel 21 facing water pipe 13. The water flows through the guide channel 21 at the side of water regulating means 20. The water then flows through a clearance (l) and is finally released at the group of shower holes 42 of the cap member 40 for a showering effect.

Figure 7:
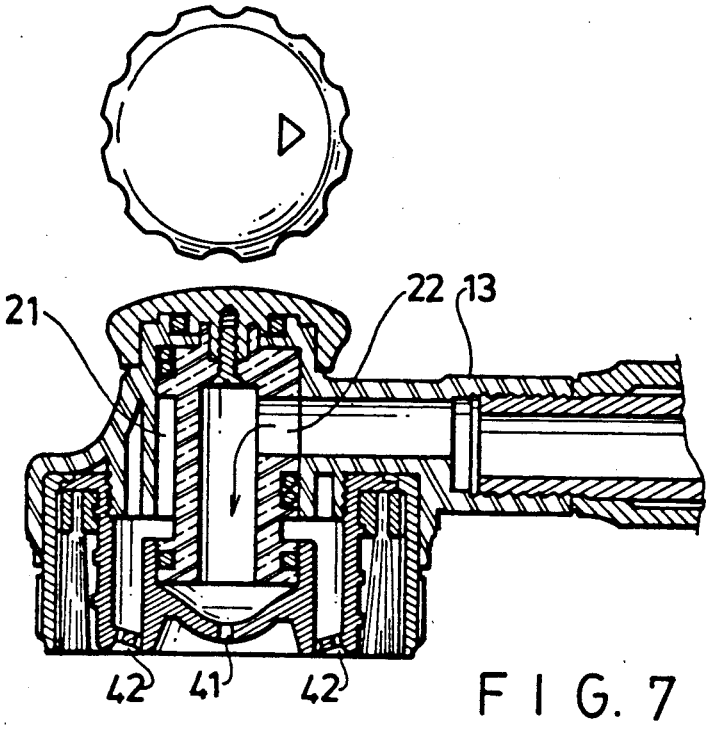
FIG. 7 is a sectional view of the present invention operating with a massaging stream.

Referring to FIG. 7, with the opening of guide channel 22 facing water pipe 13, the water passes through the guide channel 22 into the center of water regulating means 20 and is released at the group of shower holes 41 for a massaging effect.

Figure 8:
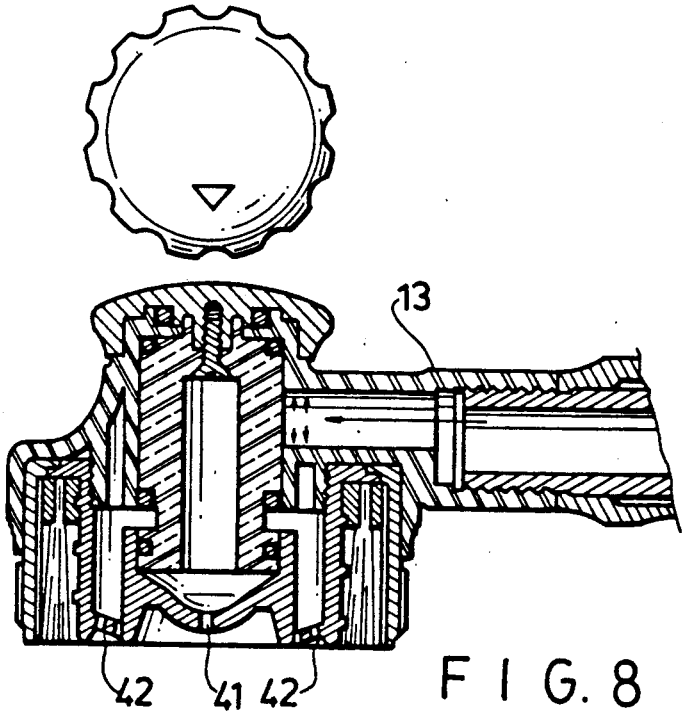
FIG. 8 is a sectional view of the present invention with water input blocked.

Referring to FIG. 8, with neither of the two guide channels 21, 22 facing the water pipe 13, water cannot flow through the water pipe 13, and therefore, no water flows out of the holes 41, 42.

Figure 9:
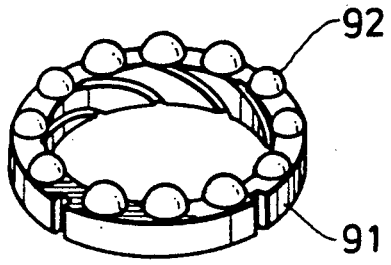
FIG. 9 is a schematic view of an embodiment of a shower utensil for this invention.
Figure 10:
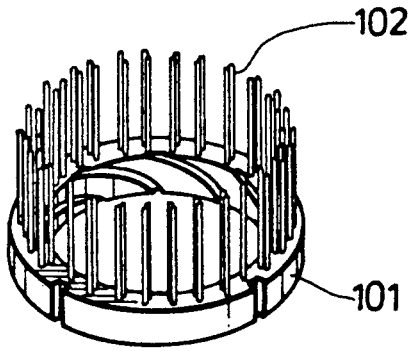
FIG. 10 is another schematic view of an embodiment of a shower utensil for this invention.

As can be seen from the preceding paragraphs, the operation of the shower utensil 60 is independent of the flow of water through the shower head 10 and vice versa. Other embodiments of a shower utensil are shown in FIGS. 9 and 10. The shower utensil of FIG. 9 has a plurality of hemispherical protrusions 91 affixed to a base 91 and is used for massage purposes. The shower utensil of FIG. 10 has a plurality of comb bristles 102 affixed to a base 101. Since the shower apparatus of this invention has detachable parts, the shower utensils are interchangeable according to the needs of the user. The shower apparatus of this invention may be made of hard plastic to make it rust proof, lightweight and more economical.

While the invention has been described with what is considered the most practical and preferred embodiment, it is understood that the invention is not limited to the disclosed embodiments, but is intended to cover various arrangements included within the spirit and scope of the broadest interpretation so as to encompass all such modifications and equivalent arrangements.

I claim:

1. A hand-held shower apparatus comprising:

a shower body having a hollow handle adaptable to connect to a source a water and a shower head having an inner cylindrical wall which forms an inner cavity communicated via the hollow handle to the source of water;

water regulating means having an axial cylindrical wall defining an axial hollow portion and fitted inside the inner cavity and rotatably mounted to the shower head and capable of being controlled externally of the shower head, the axial cylindrical wall having an opening communicated with the axial hollow portion and being disposed in such a manner that the rotation of the water regulating means can establish the communication of the opening with the source of water, and a groove similarly disposed in such a manner that the rotation of the water regulating means can establish the communication of the groove with the source of water; and a cap member, being detachably and sealingly engaged to the shower head, having an outer cylindrical wall, a perforated bottom surface joined to the lower periphery of said outer cylindrical wall, and an inner partition wall forming a first chamber and a second chamber with the perforated bottom surface such that when said cap member is engaged to the shower head, water passing through the opening of the water regulating means would be received by the first chamber, and water passing through the groove would be received by the second chamber, and a ring shaped base with a plurality of spiral grooves in its annular inner surface and a plurality of brush bristles affixed to the base, and said cap member having a plurality of spirally extending protrusions on the outer cylindrical wall for matingly engaging the spiral grooves of the base.

2. A hand held shower apparatus as claimed in claim 1 wherein the hollow handle of said shower body comprises a water pipe one end of which is connected to said water source, and a handle casing being telescopically connected with said water pipe, thereby making the hollow handle extendible by pulling the handle casing away from the shower head.

3. A hand held shower apparatus as claimed in claim 2, wherein said cap member includes an annular flange member extending outwardly from the top edge of said outer cylindrical wall, and further comprising a casing capable of being sleeved over said cap member and having an annular wall for surrounding said base, and a flange member inwardly and radially extending from the upper edge of said annular wall so as to rest on said annular flange member.

4. A hand held shower apparatus as claimed in claim 3, wherein the casing comprises a plurality of axial key member extending along its inner surface and the base has a plurality of key ways equal in number to the axial key members, the cooperation of said axial key members and said key ways hindering the relative rotation of the casing to the base.

5. A hand-held shower apparatus comprising:

a shower body having a hollow handle adaptable to connect to a source of water and a shower head having an inner cylindrical wall which forms an inner cavity communicated via the hollow handle to the source of water;

water regulating means having an axial cylindrical wall defining an axial hollow portion and fitted inside the inner cavity and rotatably mounted to the shower head, and capable of being controlled externally of the shower head, the axial cylindrical wall having an opening communicated with the axial hollow portion and being disposed in such a manner that the rotation of the water regulating means can establish the communication of the opening with the source of water, and a groove similarly disposed in such a manner that the rotation of the water regulating means can establish the communication of the groove with the source of water; and a cap member, being detachably and sealingly engaged to the shower head, having an outer cylindrical wall, a perforated bottom surface joined to the lower periphery of said outer cylindrical wall, and an inner partition wall forming a first chamber and a second chamber with the perforated bottom surface such that when said cap member is engaged to the shower head, water passing through the opening of the water regulating means would be received by the first chamber, and water passing through the groove would be received by the second chamber, and a ring shaped base with a plurality of spiral grooves in its annular inner surface and a plurality of hemispherical protrusions affixed to the base for massage purposes, and said cap member having a plurality of spirally extending protrusions on the outer cylindrical wall for matingly engaging the spiral grooves of the base.

6. A hand held shower apparatus as claimed in claim 5, wherein said cap member includes an annular flange member extending outwardly from the top edge of said outer cylindrical wall, and further comprising a casing capable of being sleeved over said cap member and having an annular wall for surrounding said base, and a flange member inwardly and radially extending from the upper edge of said annular wall so as to rest on said annular flange member.

7. A hand held shower apparatus as claimed in claim 6, wherein the casing comprises a plurality of axial key members extending along its inner surface and the base has a plurality of key ways equal in number to the axial key members, the cooperation of said axial key members and said key ways hindering the relative rotation of the casing to the base.

8. A hand-held shower apparatus comprising:

a shower body having a hollow handle adaptable to connect to a source of water and a shower head having an inner cylindrical wall which forms an inner cavity communicated via the hollow handle to the source of water;

water regulating means having an axial cylindrical wall defining an axial hollow portion and fitted inside the inner cavity and rotatably mounted to the shower head and capable of being controlled externally of the shower head, the axial cylindrical wall having an opening communicated with the axial hollow portion and being disposed in such a manner that the rotation of the water regulating means can establish the communication of the opening with the source of water, and a groove similarly disposed in such a manner that the rotation of the water regulating means can establish the communication of the groove with the source of water; and a cap member, being detachably and sealingly engaged to the shower head, having an outer cylindrical wall, a perforated bottom surface joined to the lower periphery of said outer cylindrical wall, and an inner partition wall forming a first chamber and a second chamber with the perforated bottom surface such that when said cap member is engaged to the shower head, water passing through the opening of the water regulating means would be received by the first chamber, and water passing through the groove would be received by the second chamber, and a ring shaped base with a plurality of spiral grooves in its annular inner surface and a plurality of comb teeth affixed to the base, and said cap member having a plurality of spirally extending protrusions on the outer cylindrical wall for matingly engaging the spiral grooves of the base and said cap member includes an annular flange member extending outwardly from the top edge of said outer cylindrical wall, and further comprising a casing capable of being sleeved over said cap member and having an annular wall for surrounding said base, and a flange member inwardly and radially extending from the upper edge of said annular wall so as to rest on said annular flange member.

9. A hand held shower apparatus as claimed in claim 8, wherein the casing comprises a plurality of axial key members extending along its inner surface and the base has a plurality of key ways equal in number to the axial key members, the cooperation of said axial key members and said key ways hindering the relative rotation of the casing to the base.

* * * * *